United States Patent [19]

Baughman

[11] Patent Number: 4,733,628

[45] Date of Patent: Mar. 29, 1988

[54] RECOVERABLE SEA ANCHOR AND METHOD

[75] Inventor: Joseph W. Baughman, Summersville, W. Va.

[73] Assignee: The B. F. Goodrich Company, Akron, Ohio

[21] Appl. No.: 14,576

[22] Filed: Feb. 13, 1987

[51] Int. Cl.[4] ..... B63B 21/48

[52] U.S. Cl. ..... 114/311; 244/152

[58] Field of Search ..... 114/311, 294; 244/152, 244/142, 145

[56] References Cited

U.S. PATENT DOCUMENTS

| | | | |
|---|---|---|---|
| 1,746,862 | 2/1930 | Martin | 244/145 |
| 2,361,540 | 10/1944 | Forbes | 244/145 |
| 4,534,306 | 8/1985 | Rutten et al. | 114/311 |

FOREIGN PATENT DOCUMENTS

| | | | |
|---|---|---|---|
| 13553 | of 1903 | United Kingdom | 114/311 |

*Primary Examiner*—Joseph F. Peters, Jr.
*Assistant Examiner*—Edwin L. Swinehart
*Attorney, Agent, or Firm*—Woodrow W. Ban

[57] ABSTRACT

A sea anchor wherein the shroud may rotate about a mooring line to suppress shroud line fouling and including a trip line configured for drawing the center of the shroud forwards a vessel embodying the sea anchor. The sea anchor finds use in liferafts.

5 Claims, 2 Drawing Figures

RECOVERABLE SEA ANCHOR AND METHOD

FIELD OF THE INVENTION

This invention relates to sea anchors and specifically to sea anchors having a generally flexible structure and deployed from vessels, typically smaller vessels, as a mechanism for reducing a tendency for the vessel to travel over a fluid surface in response to the force of wind and wave. More particularly, this invention relates to sea anchors including a means for the convenient and expedient recovery of such sea anchors when it is desired their deployment be terminated and to methods for terminating the deployment thereof.

BACKGROUND OF THE INVENTION

Sea anchors have been long-known. Sea anchors can be found in the naval lore dating to the 1700's where sailing ships, under the press of wind and wave during storms, have deployed sea anchors to assist in reducing undesired motion (drifting) of the vessel through the sea in response to the wind and wave. These early sea anchors would appear to have been simply a piece of sailcloth tied to a mooring line at the four corners and deployed overboard, perhaps with weighting to assure their sinkage to "fill", so to speak, with seawater as the motion of the vessel dragged the sea anchor through the water and thereby resist drifting motion of the vessel.

The stability of sea anchors has not always been completely desirable, however. For example, a sea anchor is subject to rotational forces as the sea anchor moves through the water and in the event the rotational motion is extensive, the shroud lines by which corners of the sea anchor are attached to a mooring line can become twisted, one with the next, eventually collapsing the sea anchor.

Equally, recovery of a sea anchor has traditionally required strenuous effort since during recovery the sea anchor was being pulled against the resistance of water trapped thereby; or alternately it was necessary to take the vessel to the sea anchor for recovery. As a result of both of these certain difficulties in recovering sea anchors once deployed, and certain losses as a result of sea anchors becoming foüled and requiring jettisoning, traditionally sea anchors have often been simply regarded as expendable and configured to be unhooked and allowed to sink at sea when their use was no longer required. While such simple abandonment represents a cost in lost materials and therefore, to a certain extent, has been considered undesirable, for small vessels a more serious difficulty is associated with simple abandonment of sea anchors when the weather calms. Often these small vessels can carry only a limited number of sea anchors; and in very small vessels such as liferafts, typically only a single sea anchor can be accommodated. While abandonment of the sea anchor allows the vessel free mobility again following, for example, a storm involving severe wind and wave, should the sea anchor be abandoned, subsequent storms could cause considerable difficulty for a vessel thereby found without a replacement on board.

Accordingly, a sea anchor configured to be substantially free of opportunity for self-fouling while still readily recoverable with a minimal effort could have substantial utility in commerce. Likewise, methods for retrieving sea anchors readily and means for implementing such methods could find substantial utility in commerce.

SUMMARY OF THE INVENTION

The present invention provides a recoverable sea anchor together with a method for recovering a sea anchor. The recoverable sea anchor of the invention is particularly configured to reduce significantly an opportunity for fouling of the shroud lines supporting outer edges of the sea anchor by reason of rotation of the sea anchor about an axis as the sea anchor moves thorough a fluid such as fresh or seawater.

The sea anchor of the invention includes a flexible shroud configured to assume a generally concave configuration, when viewed from the vessel to which it is attached, while in use. The sea anchor includes a coupling and further includes a shroud attachment means joining an outer periphery of the shroud with the coupling.

A means is provided on the sea anchor for connecting the coupling of the shroud to a vessel. This connecting means is rotatable through 360° and is configured to permit swiveling action throughout an arc of at least 10°. The connecting means includes an attachment means, a mooring line configured for operable connection of the coupling and the attachment means, and a trip line configured for operable connection of the attachment means with a center portion of the shroud. The trip line is configured to pass through the coupling means in a manner whereby the coupling means is rotatable about an axis defined by the trip line.

The operable connection between the attachment means and the shroud center and between the attachment means and the coupling are configured for accommodating rotational motion of the shroud relative to the attachment means without windup of the trip or mooring lines. In preferred embodiments, the trip line includes a recovery pull affixed thereto adjacent the attachment means and configured for facilitating the drawing of the trip line in a direction towards a vessel to which the sea anchor is attached.

In use the shroud lines, affixed to the coupling, are free to rotate about the trip line which extends through the coupling to a center portion of the shroud. The mooring line, attached to the coupling, carries the great preponderance of strain associated with the functioning of the sea anchor when deployed, most of this strain being transmitted along the shroud lines from a peripheral edge of the shroud to the coupling. The trip line, carrying a relatively small strain as a result of action of the sea anchor while deployed, can be drawn easily thus gradually turning the shroud inside out whereby water ceases to be trapped within the shroud and the shroud can be recovered for future use without the expenditure of great quantities of energy. The free rotational aspect of the shroud lines about the trip line and with respect to the mooring line, facilitate operation of the sea anchor under a wide variety of conditions without significant opportunity for fouling of the shroud lines due to rotation of the sea anchor shroud relative to the mooring and trip lines.

The above and other features and advantages of the invention will become more apparent when considered in conjunction with a description of a preferred embodiment of the invention together with drawings which follow together forming a part of the specification.

BEST EMBODIMENT OF THE INVENTION

Figures 1, 2:
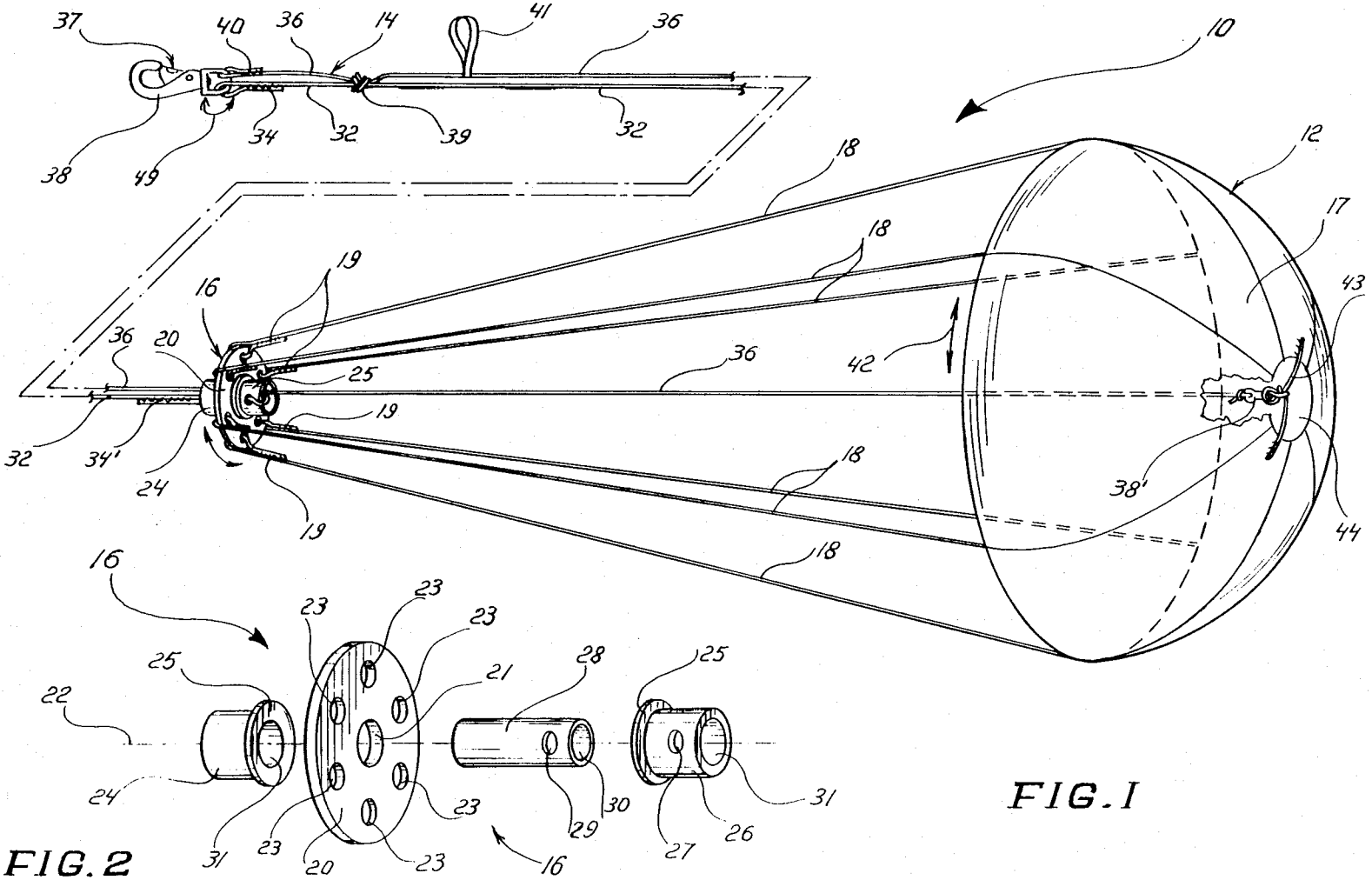
FIG. 1 is a representation of a sea anchor made in accordance with the invention.
FIG. 2 is an exploded view of a coupling suitable for use in connection with a sea anchor made in accordance with the invention.

Referring to the drawings, FIG. 1 depicts a sea anchor 10 having shroud 12, coupling 16, and connecting means 14.

The shroud 12 includes a fabric body 17. While the sea anchor 10 is in use, the fabric body 17 is configured to assume a generally concave, typically curvilinear, shape as depicted in FIG. 1. A plurality of shroud lines 18 are affixed to the fabric body 17 adjacent to an outer periphery thereof. The shroud lines 18 operably connect the coupling 16 and the fabric body 17. The shroud lines 18 pass through the coupling as shown in FIG. 1 and are fastened back upon themselves at zones 19 as shown in FIG. 1. While these zones 19 as shown in FIG. 1 are stitch-back zones, attachment of the shroud lines 18 back upon themselves following passage thereof through the coupling 16 can be accomplished in suitable or well-known manner such as by knotting, splicing, mechanical fasteners, or adhesive techniques.

The shroud lines 18 may be attached to the shroud fabric 17 employing suitable or conventional well-known techniques such as grommets or other mechanical fasteners in suitable or well-known manner, but the shroud lines 18 can equally be extensions of cording or webbing strips employed for reinforcing seams, if any, employed in the construction of the flexible fabric body 17. Likewise, depending upon the configuration of the fabric body 17 and the positioning of attachments thereof to the shroud lines 18, the concave shape of the fabric body can assume a variety of geometric shapes. The selection of a particular desired shape is within the skill of a practitioner in the art.

Turning now to FIG. 2, the coupling 16 is shown in exploded view. The coupling 16 includes a flange 20 having a central longitudinal aperture 21 centerably therethrough along an axis 22 as shown in FIG. 2. Towards an outer periphery of the flange 20, a plurality of shroud line apertures 23 are provided. These shroud line apertures 23 are spaced in a desired relationship about the aperture 21 generally in a configuration approximating the spacing of the shroud lines 18 where attached to the flexible fabric body 17. The shroud line apertures 23 are configured for accepting the shroud lines 18 as shown in FIG. 1. The flange 20 can be formed of suitable or conventional materials such as reinforced or unreinforced thermoplastics or thermosetting plastics, composites, and metals; it is substantially preferred that the flange 20 be formed of a material having a substantial resistance to the deleterious effects of seawater and capable of having distortional forces imposed by the shroud lines 18 while the anchor 10 is in use.

A spacer 28 is provided having a mooring line aperture 29 formed therein. The spacer 28 can be formed of suitable or conventional materials such as polyvinylchloride pipe or other metal or plastic pipe or tubing. It is preferred that the spacer 28 be formed of a material having substantial resistance to the deleterious defects of seawater and a strength sufficient to support forces applied by the flange 20 while the anchor 10 is in use. The spacer 28 includes a central longitudinal aperture 30 therethrough and configured for being received within the aperture 21. It is preferred in the practice of the invention that a clearance exist between a wall of the aperture 21 and an outer wall of the spacer 28 as received therein whereby the flange 20 is rotatable freely about the axis line 22 without substantial hindrance by reason of friction between the outer wall of the spacer 28 and the wall of the aperture 21.

A pair of bushings 24, 26 are provided. One bushing 26 includes an aperture 27 formed therein and configured to be the size and position to be aligned with the aperture 29 in the spacer 28. Each of the bushings 24, 26 includes a flange 25. The bushings 24, 26 are configured to have a longitudinal aperture 31 centrally therethrough. The bushings 24, 26 are configured to have an inside diameter of the longitudinal aperture 31 of a size and configuration whereby the spacer 28 may be received within the aperture 31 of the bushings 24, 26 and the apertures 27, 29 may be aligned, and whereby the flanges 25 may function to retain the flange 20 upon the spacer 28. Where the bushings 24, 26 and the spacer 28 are formed from a glueable or bondable plastic material, the bushings 24, 26, may be retained to the spacer 28 by well-known adhesive techniques. Where the elements 24, 26, 28 are formed of a metal, threading, welding, other suitable or conventional adherence or fastening techniques may be employed. Welding and threading may also be employed with certain thermoplastics and composite materials.

When assembled, the coupling 16 is configured to have a longitudinal axis 22 about which the flange 20 may rotate. Rotation of the flange 20 permits free rotation of the shroud fabric body 17 as the sea anchor is deployed and utilized in a marine environment without the shroud lines 18 becoming entangled or intertwined or rotatably fouled.

Referring again to FIG. 1, the connecting means shown generally at 14 in FIG. 1 includes a mooring line 32, a trip line 36, and an attachment means 37, which in the embodiment of FIG. 1 is a pivotable, that is rotatable, and swivelable, snap hook 38. The mooring line 32 and the trip line 36 pass through the snap hook 38 and are attached each to themselves at stitch zones 34, 40 for the mooring line 32 and the trip line 36 respectively. A knot 39 joins the trip lines 36 and the mooring line 32 adjacent the attaching means 37. The snap ring 38 may allow swiveling e.g. between the snap hook 38 and the lines 32, 36 in the direction as depicted by a line designated at reference numeral 49 in FIG. 1.

The mooring line 32 passes through the central aperture, 31 of the bushings 24, 26 and the central aperture 30 of the spacer 28, and passes through the mooring lines apertures 27, 29 in the bushing 25 and the spacer 28 of the coupling 16, whereupon the mooring line 32 returns through the apertures 30, 31 and is attached unto itself at a stitch zone 34'. Again, the stitch zones 34', 34, 40 while shown as cording stitched back upon itself, can be any suitable or conventional means for attaching cording to itself, such as mechanical fasteners, knotting, and adhesive techniques The mooring line 32 can be made of any suitable or conventional cording material such as hemp rope, polyester or nylon roping, or other suitable or conventional materials particularly having the capability of withstanding the deleterious effects of immersion and seawater while sustaining forces exerted by action of the anchor 10 while in use. It is within the purview of the invention that the mooring line 32 be formed from a webbing material in lieu of cording material. Webbing materials formed of nylon and other suitable fabrics are known.

The mooring line 32 functions to retain the coupling 16 to the attachment means 37 and to accept a large proportion of strain imposed upon the coupling 16 by action of the shroud lines 18 transmitting to the coupling 16 the forces imposed upon the shroud 12 by reason of motion of the shroud 12 relative to surrounding seawater.

The trip line 36 extends from the attachment means 37 to a center portion of the concave shape defined shroud fabric body 17. Typically, the shroud 12 includes a centrally located chimney 44. A plurality of attachment points 43 are provided adjacent the centrally located chimney 44 and a swiveling latch 38' is provided attached to the attachment points 43. The trip line 36 is attached to the swiveling latch 38' which thereby functions to attach the trip line 36 to a center of the concave shape defined by the shroud fabric body 17. By dint of action of the swiveling latch 38', the trip line is free from winding effects associated with rotational motion of the shroud 12 in directions shown generally by the double-headed arrow 42.

The trip line 36, like the mooring line 32, may be made of suitable or conventional material. The same general constraints apply to selecting a material for fabrication of the trip line 36 as would apply to the mooring line 32 with the obvious difference that the trip line 36 generally does not need to withstand a strain approaching that imposed upon the mooring line 32. For a small vessel such as a liferaft, the mooring line 32 typically is formed of ¼" cording while the trip line 36 is formed ⅛" cording.

The trip line 36 passes through central apertures 30, 31 of the spacer 28 and bushings 24, 26 of the coupling 16 generally along an axis 22 of the coupling 16. As may be readily perceived the coupling 16 may then rotate freely about the trip line 36 without becoming entangled upon the trip line 36. Likewise, the swivel capability of the swiveling latch 38' permits rotation of the mooring line 32 as the coupling 16 rotates again without entangling the trip line 36.

A pull 41 is provided on the trip line 36. As shown in FIG. 1, the pull 41 is a woven strip of sturdy material resistant to the deleterious effects of saltwater. The pull 41 is affixed to the trip line 36 generally closely adjacent the attachment means 37 and is configured for ready grasping by hand. Pulling upon the pull 41 functions to shorten the trip line 36 drawing the center portion of the concave shape defined by the fabric body 17 of the shroud 12 in a direction towards a vessel (not shown) to which the sea anchor 10 is moored. As this center portion is drawn towards the vessel, liquid within the generally concave shape of the shroud spills from the shroud 12 via the chimney 44 and the outer periphery of the shroud 12 and the shroud 12 is gradually thereby turned inside out with continued drawing on the trip line 36. Once turned inside out, the shroud 12 poses little resistance to motion through the water and may be drawn to whatever vessel is employing the sea anchor 10 of the invention. The shroud 12 may be removed from the marine environment in which it has been utilized, stored upon a vessel and the sea anchor further may be detached from the vessel by detaching the clip 38. The clip 38 can engage any suitable or conventional member (not shown) upon a vessel such as a D-ring, rod, grommet, or other mechanical member having a strength sufficient to withstand loads that may be imposed upon such a member by reason of the action of the sea anchor upon any vessel embodying the mechanical member.

It may be seen then that the sea anchor of the invention may be collapsed and withdrawn from service by simply turning the sea anchor inside out employing the trip line 36. Since the sea anchor 10 of the invention includes a shroud 12 rotatable about an axis generally 22 of the coupling 16, attempting to collapse the sea anchor by drawing upon a portion of an outer periphery thereof such as by shortening a particular shroud line, rotational forces so engendered could substantially interfere with or defeat collapsing of the sea anchor because of resulting rotation of the sea anchor 10 shroud 12 about the axis 22. Whereas, by drawing the center of the sea anchor 10 shroud 12 towards a vessel upon which the sea anchor 10 may be embodied, the shroud 12 can be collapsed with comparatively light effort.

The shroud fabric body 17 can be formed of any suitable or conventional material desirably having an extended service life in a marine environment Fabrics such as nylon, polyester, and other man-made fabrics together with cotton and the like can be employed in the practice of the invention in forming the flexible shroud 17.

While a preferred embodiment of the invention has been shown and described in detail it should be apparent that various modifications may be made thereto without departing from the scope of the claims that follow.

What is claimed is:

1. A recoverable sea anchor for a vessel comprising:

a flexible shroud configured to assume a generally concave configuration having an outer periphery while in use;

a coupling rotatable through 360°;

shroud attachment means joining the outer periphery of the shroud and the coupling;

a means for connecting and thereby mooring the coupling and shroud to the vessel rotatable through 360° and permitting swiveling action through an arc of at least 10°, including an attachment means, a mooring line operably connecting the coupling and the attachment means and a trip line operably connecting the attachment means with a center portion of the shroud, the trip line being configured to pass unattachably through the coupling whereby the coupling is capable of rotational motion about an axis defined by the trip line, the operable connection between the attachment means and the shroud center and between the attachment means and the coupling being configured for accommodating rotational motion of the shroud relative to the attachment means without fouling or windup of the trip or mooring lines.

2. The sea anchor of claim 1 including a handle means affixed to the trip line adjacent the attachment means and configured for facilitating drawing the trip line towards the vessel to which the sea anchor is moored.

3. The sea anchor of claim 1, the shroud attachment means being shroud lines, and the coupling comprising a centrally apertured flange means having apertures formed therein configured for receiving the shroud lines in a spaced relationship about the flange means central aperturecorresponding to a spaced relationship characterizing attachment of the shroud lines to the shroud about an outer periphery thereof, and further including a spacer having a longitudinal central aperture therethrough, the spacer being received within the centrally apertured flange and being of a size and configuration whereby when so received the flange may freely rotate about the spacer, and further including a pair of having central longitudinal apertured retainers configured to retain the spacer within the centrally apertured flange and further configured to permit passage of the trip line through the longitudinal central apertures of the spacer and central longitudinal aperture of the retainers, the spacer and at least one of the retainers being configured to accept a passage of the mooring line therethrough in a manner configured for retaining the mooring line to the coupling.

4. A recoverable sea anchor for a vessel comprising:

a flexible shroud formed from a fabric material and having a generally concave, curvilinear configuration, the shroud including a central chimney;

shroud attachment lines attached to the shroud and spaced generally regularly around an outer periphery of the shroud;

a coupling including a centrally apertured flange portion having shroud apertures therein configured for receiving the shroud lines, the shroud apertures being spaced in a generally regular manner around the flange central aperture in a manner corresponding generally to positioning of shroud lines around the periphery of the shroud, the shroud lines being received in the flange shroud line apertures in a manner configured to retain the shroud to the flange, the coupling further including a spacer having a longitudinal central aperture therethrough the spacer being received in the flange central aperture in manner permitting rotation of the flange about the spacer and a pair of retaining bushings having longitudinal central apertures and configured to receive the spacer within the bushing central apertures and to retain the spacer within the central aperture of the flange, the spacer and at least one of the bushings including an aperture configured for receiving a mooring line and thereby retaining the coupling to the mooring line;

means for connecting the coupling and shroud to the vessel, the connecting means being rotatable through 360° and permitting swiveling action through an arc of at least 10°, including a swivel snap hook, a mooring line operably connecting the swivel snap hook and the coupling employing the mooring line receiving apertures, and a trip line operably connecting the swivel snap hook with the central chimney of the shroud, configured to pass through the coupling by passing through the longitudinal central aperture of the spacer;

an attachment point adjacent the shroud chimney and a swivel connector operably connecting the attachment point with the trip line.

5. The sea anchor of claim 4 including a strap-like means affixed to the trip line adjacent the swivel snap hook and configured for assisting in the drawing of the trip line into the vessel to which the sea anchor is attached.

* * * * *